United States Patent [19]

Jennings

[11] Patent Number: 4,749,190

[45] Date of Patent: Jun. 7, 1988

[54] CONVERTIBLE EXERCISE BENCH

[75] Inventor: Homer F. Jennings, Olney, Ill.

[73] Assignee: Weider Health & Fitness, Woodland Hills, Calif.

[21] Appl. No.: 38,412

[22] Filed: Apr. 13, 1987

Related U.S. Application Data

[63] Continuation of Ser. No. 796,151, Nov. 8, 1985, abandoned.

[51] Int. Cl.[4] ..... A63B 17/00

[52] U.S. Cl. ..... 272/144; 272/123

[58] Field of Search ..... 272/123, 144, 145, 117, 272/134, DIG. 4

[56] References Cited

U.S. PATENT DOCUMENTS

| | | | |
|---|---|---|---|
| 3,342,485 | 9/1967 | Gaul | 272/123 |
| 4,201,380 | 5/1980 | Birch | 272/123 |
| 4,226,415 | 10/1980 | Wright | 272/134 X |
| 4,423,865 | 1/1984 | Manner | 272/123 |
| 4,546,967 | 10/1985 | Kecala | 272/144 X |
| 4,566,691 | 1/1986 | Mahnke | 272/123 |
| 4,575,077 | 3/1986 | Osborne et al. | 272/134 |
| 4,582,319 | 4/1986 | Luna | 272/123 X |
| 4,635,934 | 1/1987 | Roethke | 272/144 |

FOREIGN PATENT DOCUMENTS

| | | | |
|---|---|---|---|
| 2514263 | 4/1983 | France | 272/144 |
| 2076299 | 12/1981 | United Kingdom | 272/144 |

*Primary Examiner*—Richard J. Apley
*Assistant Examiner*—J. Welsh
*Attorney, Agent, or Firm*—Blakely, Sokoloff, Taylor & Zafman

[57] ABSTRACT

A convertible exercise bench includes a bench frame having a generally horizontal plane and two movable barbell suport members that may be positioned along a horizontal axis of the frame. The bench includes a platform having a head section and a foot section, pivotally joined at a location intermediate the ends of the bench, so that the platform may be configured in a V-shaped, or inverse thereof, an incline or a decline respective to the horizontal axis of the bench. A removable support member is used to support the head section, independent of the movable vertical barbell supports, and a lockable leg exercise member is attached to the foot section end of the bench.

11 Claims, 3 Drawing Sheets

CONVERTIBLE EXERCISE BENCH

This is a continuation of application Ser. No. 796,151 filed 11/8/85 now abandoned.

FIELD OF THE INVENTION

The present invention relates to apparatus for a multipurpose convertible exercise bench, and more particularly, to a convertible exercise bench that may be configured by a user into a plurality of different positions thereby allowing a user to perform a multitude of different exercises.

BACKGROUD OF THE INVENTION

Over the years weight lifting has increasingly gained in popularity. More recently, the sport and science of weight lifting has grown significantly. Such growth and the accompanying public demand has generated new research thereby resulting in the design of more specialized apparatus than has heretofore been required.

The traditional exercise bench consists of a bench frame supporting a platform, with two vertical barbell supports disposed at one end of the platform to support a barbell above and near the head of a user or weightlifter. The user, lying upon the bench in a supine position, lifts a barbell off the vertical supports by extending his arms upward, and then exercises by contracting and extending his arms a desired number of times. This exercise, commonly called bench pressing, is used for exercising and developing upper torso muscles, particularly the pectorals and triceps, by virtue of the user's exertion against the resistance of the weighted barbell. Upon completion of the bench press exercise, the user replaces the barbell onto the vertical supports.

Variations and modifications of the traditional bench press have been developed over the years. These developments have included means for raising the end of the platform adjacent the user's head thereby raising the upper torso to an inclined position, and thereby allowing selective development of desired upper torso muscle groups.

Other modifications have been made to the traditional exercise bench, such as the addition of weighted or resistance leg exercising means. The leg exercise means generally comprise an inverted pivotal L-shaped or circumferential bar having foot sections and being connected to the end of the frame opposite the vertical support members. Using the leg exercise means the user may exercise the quadricep, or front thigh muscle groups in the leg region, or the bicep, or back thigh muscle groups.

Various other forms of benches for different exercises have also been designed. Typically, in order to engage in a full spectrum of upper and lower torso exercises, the user would have to use several different types of benches. For example, in order to most properly perform "presses" (arm extensions while the user's vertebrae are vertical) a prior art bench has been designed having an "L" shaped platform, the vertical portion of which adds support to the back of the user, thereby minimizing the risk of damage to the user's vertebrae and positioning the user's back in the proper position for the most successful development of the shoulder muscle groups. Another type of bench, commonly called the "curl" bench, consists of an inclined back portion and a seat portion attached perpendicularly thereto, the seat portions being disposed at an angle approximately 45° respective to the floor. A user will then sit in the bench, typically using two dumbbells and perform arm contraction exercises, also known as curls. When a user lies on the inclined back portion and performs a dumbell curl, the range of movement of his arms, and tension on the biceps, with respect to the back portion, is approximately 225°. This develops the biceps more efficiently than if the user were standing and performing curls since the range of tension on the biceps while standing, would only be approximately 180°. Also, the approximate 45° angle of the seat portion of a curl bench is necessary to prevent the user from sliding along the bench and off the seat by virtue of the downward force exerted by the arm contractions and dumbbells.

When performing presses or bench presses, it is desirable to incline the back portion of the bench because, in general, the higher the inclination of the back portion of the bench, the more stress is placed upon the upper torso and shoulder area of the user. Prior art benches having an inclining back portion, typically have the back portion supported at one end by the vertical barbell support members. However, prior art benches have vertical barbell support members which are fixed in position relative to the frame. Thus, once the back support platform is raised above and sufficiently in front of the vertical support members, the barbell could not be reached by a user and is therefore no longer useful as a barbell support. Accordingly, the fixed position of the vertical support members has, in the past, been a limitation on the degree of inclination at which such an adjustable bench may be positioned.

SUMMARY OF THE INVENTION

The present invention overcomes the aforementioned difficulties of the prior art benches, in a single convertible multipurpose bench that allows a user to modify positions of various elements of the bench to convert the bench to a form necessary to perform the above mentioned exercises, in addition to many other types and forms of exercises. By virtue of the adaptability of the present invention, an exerciser may, in a single bench, have available to him the means to exercise a wide range of muscle groups without requiring different and separate exercise benches or other equipment and without the use of tools.

Accordingly, the present invention relates to a convertible exercise bench for barbell, dumbbell, and calisthenic exercises having selectively positionable barbell support members. The bench includes a bench frame disposed in a substantially horizontal plane; a pair of vertical barbell supports slidably mounted to the frame and horizontally movable therealong for supporting a barbell; a platform supported by the frame comprising a head section, and a foot section, the head section being pivotally attached to a first pivot means at the end thereof intermediate the platform so that the other end of the head section may be raised or lowered; and a removable support means slidably mounted to the frame for supporting the head section in a desired position within a predetermined range. The slidably mounted vertical barbell supports may be positioned along the length of the bench so that they are disposed near the head of the user when the platform is positioned at any preselected angle within the range of movement of the platform, so that the user can comfortably reach a barbell disposed thereon. The frame of the convertible exercise bench may be provided with at least one lower horizontal long axis member and at least one upper horizontal long axis member substantially parallel thereto. The vertical supports are slidably mounted on the lower and the upper long axis members, thus providing a track for horizontal translation of the vertical supports so that the supports may be selectively positioned along the long axis members at a position comfortable for a user.

The foot section of the convertible exercise bench may be pivotally coupled to the first pivot means at its end, intermediate the platform, so that the foot section may be selectively positioned at a desired degree of inclination or declination, within a predetermined range so that cooperatively, the head section and the foot section may form a V-shape, or the inverse thereof, when the first pivot means is raised or lowered, relative to the horizontal plane of the platform when the head and foot sections are coplanar.

The present invention may also be used with the aforementioned leg exercise member. However, unlike prior art benches equipped with similar leg exercise members, the present invention employs a locking means for locking the traditionally pivotal leg exercise member in a fixed position relative to the frame. When the locking means is engaged, and a configuration of the bench is selected, the user may perform situps or back extensions at a preselected angle to the horizontal plane.

These and other uses and associated apparatus will become apparent from the following description.

DETAILED DESCRIPTION OF THE PREFERRED EMBODIMENT

Figure 1:
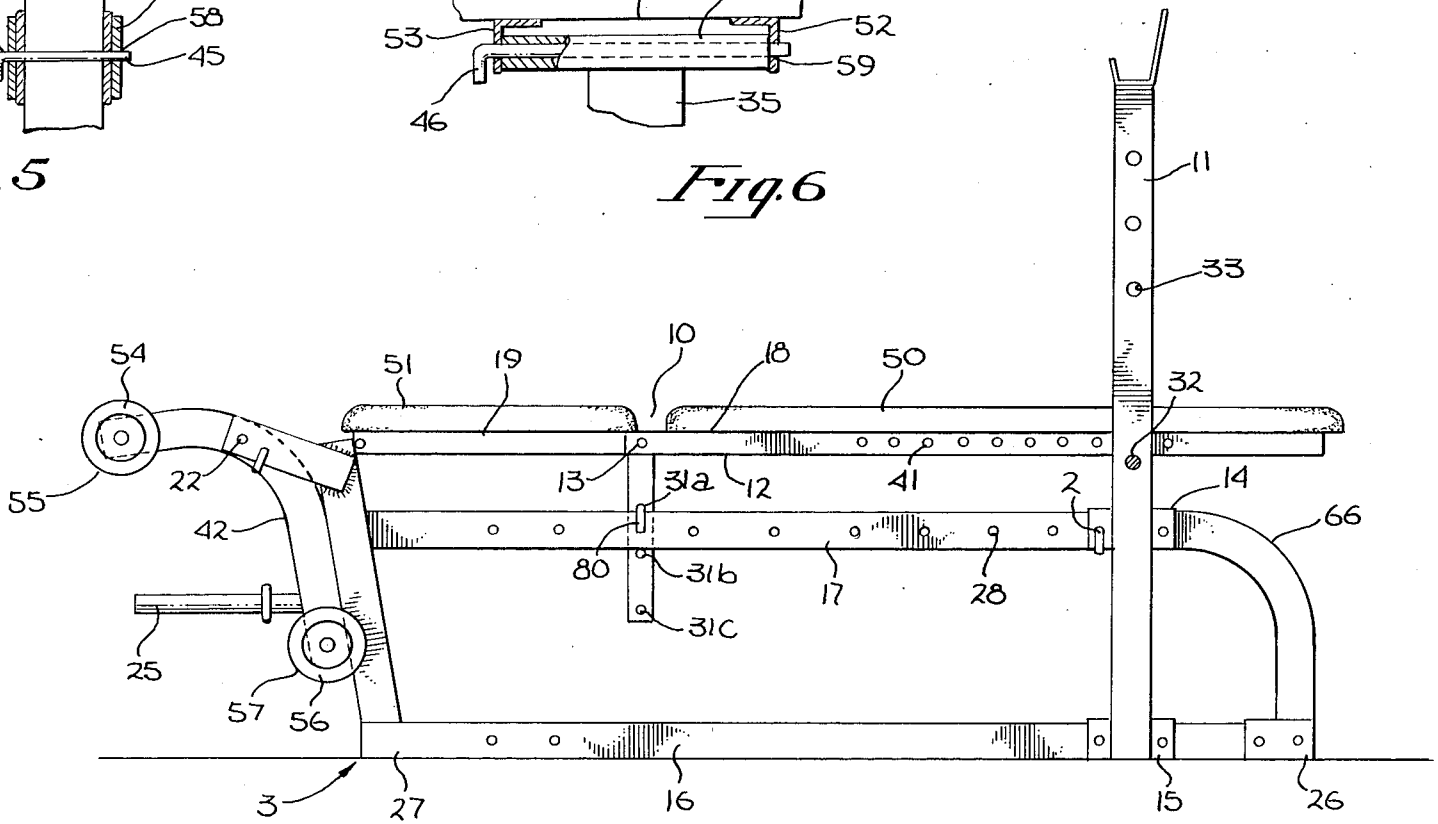
FIG. 1 is a side view of the convertible exercise bench in the planar position.

Referring now to FIG. 1, there is shown the invented convertible exercise bench 10 generally comprising a frame 3 with a platform 12 disposed thereon, and vertical barbell support members 11 slidably mounted thereto. The frame 3 comprises a head end base 26, horizontal upper 17 and lower 16 long axis members connecting the head end base 26 to the foot end base 27. Vertical barbell supports 11 comprises a unitary, generally U-shaped member, which is slidably mounted to both the lower long axis member 16 and the upper long axis member 17 by means of the slidable mountings 14 and 15.

Figure 2:
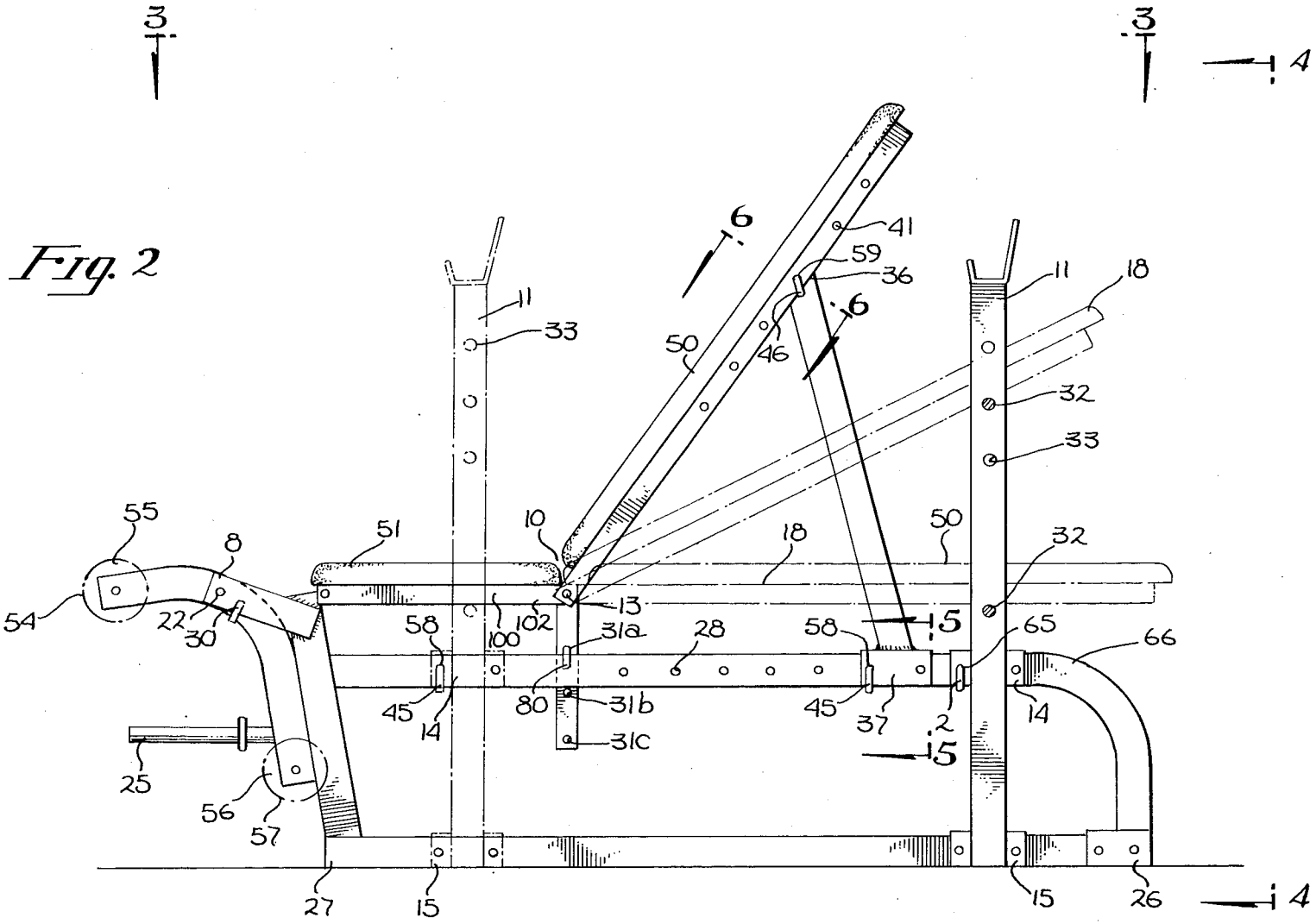
FIG. 2 is a side view of the convertible exercise bench showing the vertical barbell support members in two positions.
Figure 4:
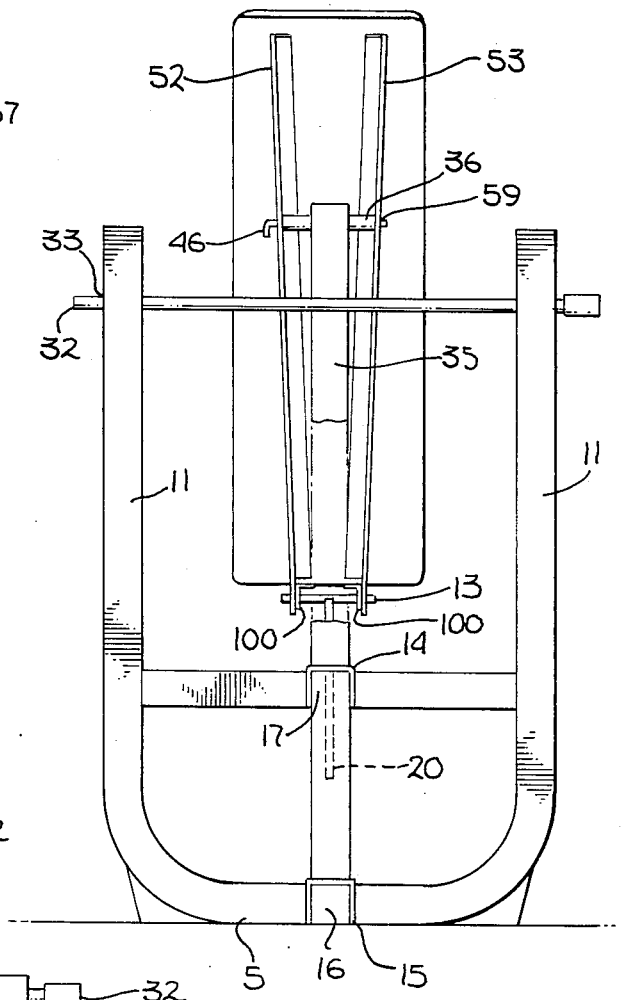
FIG. 4 is a back view of the convertible exercise bench taken through lines 4—4 of FIG. 2.

In FIG. 4, there is shown a back view of the convertible exercise bench, taken through lines 4—4, of FIG. 2, wherein the vertical barbell supports 11, join in a generally U-shaped base 5, and are slidably mounted upon the upper long axis member 17 and lower long axis member 16. Also shown in FIG. 4 are the upper slidable mountings 14 and the lower slidable mountings 15, both being mounted transverse to the upper 17 and lower 16 long axis members respectively and which allow the U-shaped structure comprising the vertical barbell supports 11, to be moved along the long axis members 16 and 17. Cross bar 4 adds lateral stability to vertical barbell supports 11. Acccordingly, the vertical barbell supports may be jointly moved horizontally along the length of the bench, such as from the position shown in FIG. 1, towards the foot end base 27, as shown in phantom lines in FIG. 2. The long axis members 16 and 17 collectively serve as a guides or tracks for such horizontal translation. As shown in FIGS. 1 and 2, the upper long axis member 17 is also provided with position select holes 28 which are disposed there along, in predetermined increments, for securing the vertical barbell supports 11 in a predetermined position, in corresponding increments. The vertical barbell supports may be locked into a selected location by aligning the apertures 2, in the upper slidable mountings 14, with the position select holes 28, and inserting a locking bar 65 therethrough. Of course, it will be appreciated that other locking devices other than holes and lock pins may be used. Also, although we have shown two slidable mountings, it will be appreciated that any number of slidable mountings may be used.

In FIGS. 1 and 2 the platform 12 is shown having a pivotal head section 18 and a pivotal foot section 19. Platform 12 has pads 50 and 51 disposed thereon for a user's comfort. Head and foot sections 18 and 19 are pivotally mounted at platform pivot means 13, intermediate platform 12. The head section 18 is supported, in FIG. 1, at the end adjacent the vertical support members by a head section support bar 32. Head section support bar 32 may be disposed at different heights along vertical barbell supports 11 by insertion thereof through a preselected pair of opposing incline select holes 33, disposed incrementally along barbell supports 11. Removal of the back section support bar 4 will allow the head section platform 18 to rest upon the upper long axis member 17 at location 66 of FIGS. 1 and 2. In this position, the back section platform 18 would be declined at an angle of approximately −20°, with respect to the horizontal, so that when a user is disposed thereon his pectorals are lower than his knees. This configuration of the bench would allow a user to more effectively develop the lower pectoral muscles.

Midplatform adjustable support member 20 is pivotally attached to platform pivot means 13 and is slidably engaged with the upper long axis member 17. Vertical select holes 31 *a*, 31 *b* and 31 *c* are disposed continuously, in predetermined increments, along the midplatform adjustable support member 20 for supporting the platform 12 in a raised or lowered position, within a certain range, when the support member 20 is vertically translated in increments corresponding to vertical select holes 31 *a*, 31 *b* and 31 *c*. Accordingly, platform 12 may be configured in a V-shaped (or the inverse thereof) having an angle which is partly determined by the height to which the platform pivot means is raised above the upper long axis member 17. Further, the midplatform adjustable support member 20 may be locked into position by inserting a pin 80 through a desired vertical select hole 31. Also, it will be appreciated that when platform pivot means 13 is raised, and head section support bar 32 is removed so that the head platform section 18 platform rests at location 66 (as previously discussed), the angle of declination of head section platform section 18 may be increased to an angle of approximately 45° respective to the horizontal plane, thus allowing greater concentration on the lower pectoral muscles when performing bench presses. It will also be appreciated that the mobility of platform sections 18 and 19 allow a user to configure the bench 10 as the traditional "curl bench" (previously discussed) as well as other desirable configurations.

After a configuration of the platform is selected, the vertical barbell supports may then be moved to a location along the horizontal axis, to allow a user easy access to a barbell resting thereon and also to conform with the selected platform configuration wherein the barbell may be supported in a position to afford maximum development of desired muscle groups.

In FIG. 2 there is shown, in phantom lines, the head section platform 18 resting upon head section support bar 32, which mounts through vertical barbell supports 11, as previously discussed. Such support means are traditional in the prior art. However, in the present invention the support member 35 may support the head section platform 18 in place of the head section support bar 32. When support member 35 is used to support the head section platform 18, back section support bar 32 may be removed from the vertical barbell supports 11, which may then be horizontally translated towards the foot end base 27 to a position, for example, as shown in phantom lines in FIG. 2. The support member 35 may support head section platform 18 at an incline within a range of approximately 45° to 75°, respective to the horizontal plane, thus allowing a user to configure the bench 10 as a "press bench" (previously discussed) as well as other desired configurations.

The invented bench, unlike prior art benches, allows a user to configure the head section platform 18 and foot section platforms 19, so that the apex of the head section 18 and the foot section 19 forms an angle of up to approximately 260° when measured from the side facing a user lying thereon. Accordingly, by virtue of the alternate support provided by support member 35 or support bar 32 of the head section platform 18, the mobility of the vertical barbell supports 11, the pivotal mobility of platform sections 18 and 19, adjustable support member 20, and the associated elements, a user of the convertible exercise bench 10 may configure the same to correspond to a desired exercise so that a user may perform a plurality of separate exercises, thereon, thereby increasing the number of muscle groups that may be exercised on a single bench.

Also shown in FIG. 2 is the stationary leg exercise bracket 8 which extends generally horizontally from the leg end base 27 of frame 10. Pivotally mounted, generally circumferential, leg exercise member 42 is pivotally attached to leg exercise bracket 8 at leg pivot means 22. As shown in FIG. 4, the leg exercise member has disposed on both sides, and at opposite ends thereof, rotary cushions 54, 55, 56 and 57 for affording comfort to the legs and ankles of a user. A lock pin 30 may be placed through lock holes 29, in the stationary leg exercise bracket 8, and the upper portion of the pivotal leg exercise member 42, thereby locking the leg exercise member 42 in a stationary position to resist the generally vertical forces exerted by the legs of a user. When the leg exercise member 42 is locked in such a position, an exerciser may utilize the stationary leg exercise member 42 for various exercises, such as incline or decline sit-ups, or back extensions. Sit-ups can be performed either with the legs tucked behind upper pads 54 or 55, such as for straight leg sit-ups, or behind lower pads 56 and 57 for bent leg sit-ups. Alternatively, with the user lying on his stomach, with his legs tucked behind the upper pads 54 and 55, the user can arch his back, thereby raising his head upward to exercise his back muscles. Additionally, without the use of lockpin 30, leg exercise member 30 is pivotal so that weight disks may then be placed upon weight support member 25, to afford greater resistance to the generally vertical forces exerted by the legs of a user, for leg curls and other leg exercises. Of course, resistance may be added to the pivotal leg exercise member in the form of elastics, pullies, gears, or other resistance producing techniques. In this fashion a user has available to him means to exercise and develop the leg region muscle groups, or lower torso region muscle groups, in a single device.

The leg exercise member 42, when pivotal, may be used in cooperation with selected desired configurations of platform 12, as previously discussed. For example, when the platform pivot means 13 is lowered below the plane defined by the head section 18 and foot section 17, when they are horizontal, the thigh of a user laying on his back is angled upward and the lower portion of the leg is vertical, thus forming an angle of greater than 90°. This angle forces the user to limit his movements to the muscles involved, thereby concentrating on the exercise of his front thigh muscles. This configuration of the exercise bench also provides a greater range of rotational motion of the leg during the exercise.

When the platform pivot means 13 is raised above the horizontal position, the user may lie on the platform on his stomach with his waist bent over the crest formed at the pivot means 13 so that his upper torso extends on the head section 18 of the platform. Thus, when in this position, the user curls the leg exercise member 42 towards his buttocks, the backward pull of this action is resisted mainly by the force of the upper body against the downward slanting platform of the bench, rather than solely by the weight of the user's torso. Due to this configuration of the invented bench there is a lesser tendency for the user to arch or jerk his back and, consequently, there is less risk of injury.

Figure 6:
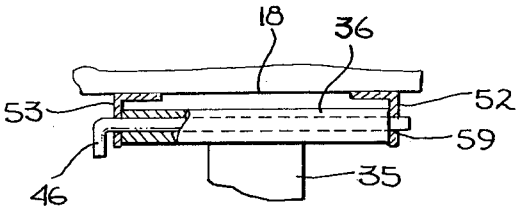
FIG. 6 shows a cross-sectional break away view of the T-shaped member taken through lines 6—6 of FIG. 2.

In FIGS. 2 and 4 there is shown the convertible exercise bench having a head section support member 35, detachably coupled to the upper long axis member 17, by means of a generally U-shaped slidable coupling 37 (also shown in FIG. 5) at one end and detachably coupled at the other end to the underside of platform section 18, at brackets 52 and 53, by means of a generally T-shaped detachable coupling 36 (shown in FIG. 6). When the slidable coupling 37 is slid towards the foot end base 27, the head section platform is raised, and when the slidable coupling 37 is slid toward the head end base 26, the head section platform is lowered. The slidable coupling 37 is also, preferably, pivotal with respect to head section support member 35 to provide a greater range of horizontal translation of the slidable coupling 37 along upper long axis member 17. Further, the head section support member 35 is preferably removable in order not to interfere with the full range of motion of the back section platform 18. The head section support member 35 may be locked into a desired location by inserting a lock pin 45 through apertures 58 in the pivotal detachable coupling 37 and the position select holes 28, which are disposed incrementally along the upper long axis member 17. The upper end of the back section support member 35 may be locked into a position at the underside of the back section platform 18 by aligning an aperture 59, in the T-shaped detachable coupling 36, with lock through holes 41, which are disposed incrementally along channels 52 and 53, and insertion of a lock pin 46 therethrough. It will be appreciated that other fastening devices may also be used to secure support member 35 to the back section support platform 18 and the upper long axis member 17.

FIG. 6 shows a close break-away view of the T-shaped detachable coupling 36 for coupling head section support member 35 to the head section platform 18. Lock pin 46 is removable so that head section support member 35 can be detached from the bench 10. As mentioned, detachable coupling 36 forms a generally T-shaped structure for engaging with channels 52 and 53. Coupling 36 may also be pivotal to provide easier coupling to channels 52 and 53.

The lock through holes in the back section channels 52 and 53 and the upper long axis member 17, may be disposed incrementally and continuously along the respective elements to afford a user a wide range of selected desired positions, in corresponding increments, of back section 18 and thus enabling the development of a wide range of muscle groups at such positions.

Figure 3:
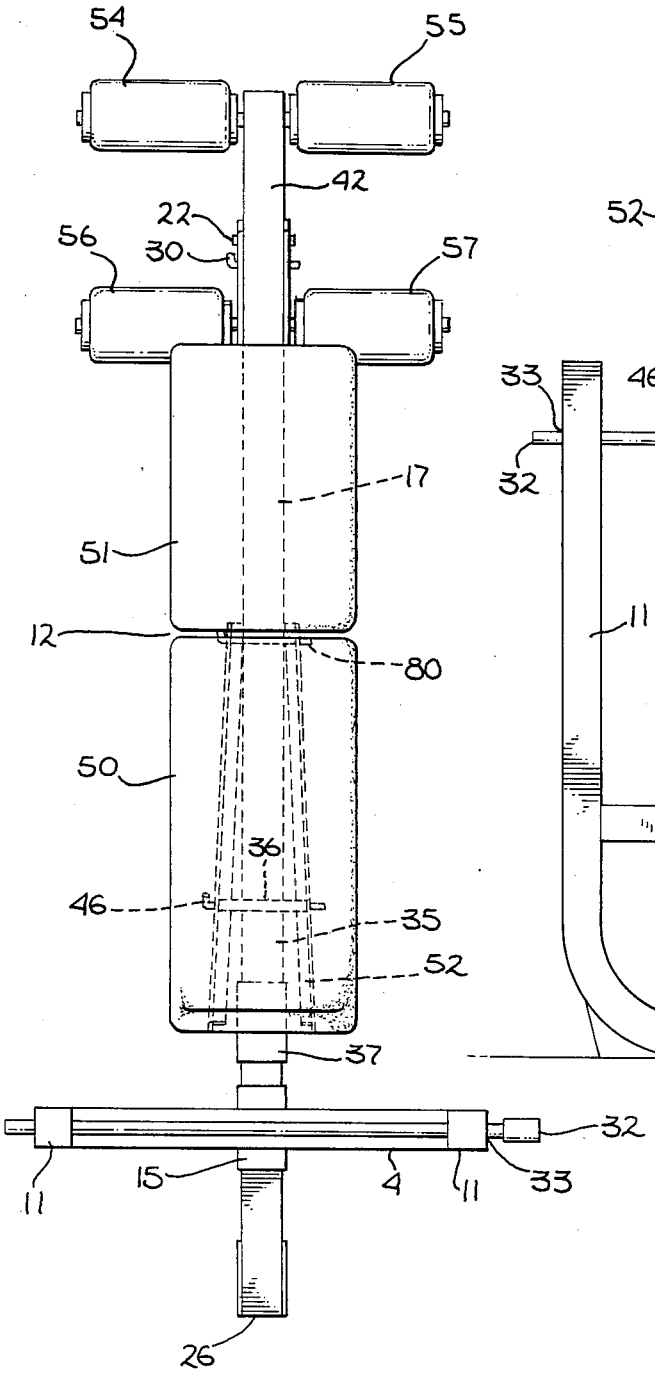
FIG. 3 is a top view of the convertible exercise bench taken through lines 3—3 of FIG. 2.

In FIG. 3 there is shown a top view of the convertible exercise bench, taken through lines 3—3 of FIG. 2, showing vertical support members 11, head section support bar 32, head end base 26, pivotally mounted leg exercise member 42, leg exercise bracket 8, rotary pads 54, 55, 56, 57, platform sections and 18 and 19, channels 53 and 54 (shown in phantom lines), and support member 35 (also shown in phantom lines). Also shown in phantom lines are T-shaped detachable coupling 36, lock pin 46 and slidable coupling 37.

FIG. 4 shows a back view of the bench 10 in which adjustable support member 20 is shown therein, partly in phantom lines. Platform pivot means 13 is also shown partly in phantom lines. Coupled to platform pivot means 13 are channels 53 and 54 and channels 100 and 102 Channels 100 and 102 are attached to the underside of foot section platform 19 to provide support thereof.

Figure 5:
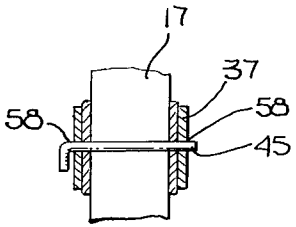
FIG. 5 is a cross-sectional view of the U-shaped bracket taken through lines 5—5 of FIG. 2.

In FIG. 5 there is shown an end cross sectional view, taken through lines 6—6 of the slidable coupling 37 mounted on the upper long axis member 17 and lock through pin 45 interposed therethrough. Coupling 37 generally forms a U-shaped bracket for coupling to and slidably engaging with the upper long axis member 17.

FIG. 6, as mentioned, shows a close, breakaway view of the T-shaped detachable coupling 36.

The above described invention may be embodied in other specific forms without departing from the spirit or essential characteristics thereof. The present embodiments are, therefore, to be considered in all aspects as illustrative and not restrictive, the scope of the invention being indicated by the appended claims rather than by the foregoing description, and all changes which come within the meaning and range of equivalency are, therefore, intended to be embraced therein.

What is claimed is:

1. A convertible exercise bench for barbell, dumbell, and calisthethic exercise having linearly horizontally movable barbell supports comprising:

a bench frame disposed in a substantially horizontal plane and having a predetermined length;

a horizontal track disposed along substantially the length of said frame and coupled to said frame;

a pair of vertical barbell supports for supporting a barbell, said supports being parallel to one another, horizontally slidably mounted on said horizontal track and fixable in position relative to said horizontal track;

a platform disposed on said frame comprising a head section and a foot section;

a first pivot means coupled to said head section and said foot section at a location intermediate said platform so that said head section may be raised or lowered to a desired degree of inclination or declination within a predetermined range respective to said horizontal plane; and a support means for supporting said head section at said desired degree of inclination within a predetermined range;

wherein said slidably mounted vertical supports may be positioned along said horizontal track and said head section may be supported by said support means at a desired degree of inclination, within a predetermined range, thereby permitting a user to configure said bench to any of a plurality of configurations and to perform exercises thereon so that different muscle groups can be exercised using a single bench.

2. The convertible exercise bench of claim 1 wherein said vertical barbell supports further comprise a head section platform support comprising a horizontal support removably secured to said vertical barbell supports and positioned transverse to the long axis of the frame.

3. The convertible exercise bench as claimed in claim 1 wherein said foot section abuts said head section and is pivotally coupled to said first pivot means, whereby said foot section may be selectively positioned to a desired degree of inclination or declination, within a predetermined range, so that cooperatively, said head section and said foot section may form a V-shape, an inverse thereof or be inclined or declined respective to said horizontal plane.

4. The convertible exercise bench as claimed in claim 1 wherein said horizontal track further comprises:

a lower substantially horizontal member; and an upper substantially horizontal member;

said upper and said lower members extending along the long axis of said frame and being coupled thereto at the ends thereof such that said vertical supports are slidably mounted on both said lower member and said upper member, said members providing a track for horizontal translation of said vertical supports so that said vertical supports may be selectively positioned relative to a user's body disposed on said platform..

5. The convertible exercise bench as claimed in claim 4 wherein said support means comprises a unitary elongate member coupled at one end to said head section and slidably mounted at the other end of said elongate member to said upper member, whereby said other end of said elongate member may be selectively positioned along said upper member, so that said head section is thereby supported at a desired degree of inclination within a predetermined range.

6. The convertible exercise bench as claimed in claim 5 further comprising:

an adjustable support member for supporting said first pivot means, said adjustable support member extending generally downwardly from said first pivot means and being slidably engaged with said upper member, so that said first pivot means, said head section and said foot section may be raised or lowered cooperatively, when said adjustable support member is vertically translated.

7. The convertible exercise bench as claimed in claim 6 further comprising a leg exercise means including;

a generally circumferential bar having cushions mounted on each end thereof;

a bracket extending generally outwardly from said frame at an end of said frame adjacent said foot section;

a second pivot means coupling said bar to said bracket; and a locking means for securing said bar to said bracket so that said bar is stationary thereby resisting generally vertical forces exerted by the legs of a user.

8. The convertible exercise bench as claimed in claim 6 wherein said adjustable support member further comprises a plurality of apertures disposed along the length thereof, in predetermined increments, for selectively determining, in corresponding increments, a desired degree of vertical translation of said adjustable support member.

9. The convertible exercise bench as claimed in claim 5 wherein said support means further comprises:

a generally T-shaped member disposed at one end of said elongate member;

at least one channel disposed along the underside of said head section and having a plurality apertures incrementally disposed thereon in predetermined increments for coupling said T-shaped member thereto at a selected aperture thereby determining in corresponding increments the degree of inclination of said head section;

a first detachable coupling means for coupling said T-shaped member to said channel, wherein said channel acts as a track for said T-shaped member which may be selectively coupled thereto at a desired aperture;

a generally U-shaped member being pivotally connected to said elongate member at the end opposing said T-shaped member and slidably mounted on said upper long axis member;

a second detachably coupling means for coupling said U-shaped bracket to said upper member, said upper member having a plurality of apertures incrmeentally disposed thereon in predetermined increments for coupling said U-shaped member thereto at a selected aperture, thereby determining in corresponding increments the degree of horizontal translation of said U-shaped bracket, and wherein said upper member serves as a track for said U-shaped member.

10. A convertible exercise bench for barbell, dumbell, and calisthenic exercises having selectively positionable barbell supports comprising:

a bench frame disposed in a substantially horizontal plane;

at least one substantially horizontal long axis member extending along the long axis of said frame and being coupled thereto at the ends thereof;

a pair of vertical supports for supporting a barbell, said vertical supports being parallel to one another and slidably mounted on said long axis member so that said vertical supports may be selectively positioned horizontally along said long axis members;

a platform disposed on said frame comprising a head section and a foot section;

a first pivot means coupling said head section and said foot section at a location intermediate said platform so that cooperatively said head section and said foot section may form a V-shaped an inverse thereof, an incline or a decline respective to said horizontal plane;

an adjustable support member for supporting said pivot means, said adjustable support member extending generally downwardly from said first pivot means and slidably engaged with said long axis member, so that said first pivot means and said head and said foot sections may be raised or lowered cooperatively when said adjustable support member is vertically translated; and a support means for supporting said head section at a desired degree of inclination, within a predetermined range.

11. The convertible exercise bench of claim 10 wherein said vertical barbell supports further comprise a head section platform support comprising a horizontal support removably secured to said vertical barbell supports and positioned transverse to the long axis of the frame.

* * * * *